United States Patent [19]

Tsubo

[11] Patent Number: 4,674,736

[45] Date of Patent: Jun. 23, 1987

[54] SHEET FEEDING APPARATUS

[75] Inventor: Shuzo Tsubo, Kawasaki, Japan

[73] Assignee: Tokyo Shibaura Denki Kabushiki Kaisha, Kawasaki, Japan

[21] Appl. No.: 775,720

[22] Filed: Sep. 16, 1985

Related U.S. Application Data

[63] Continuation of Ser. No. 479,848, Mar. 28, 1983, abandoned.

[30] Foreign Application Priority Data

Mar. 30, 1982 [JP] Japan ..... 57-52021

[51] Int. Cl.[4] ..... B65H 3/52; B65H 9/04

[52] U.S. Cl. ..... 271/122; 271/146; 271/245

[58] Field of Search ..... 271/164, 3.1, 37, 38, 271/121, 122, 124, 125, 263, 245, 246, 251, 10, 118; 414/43

[56] References Cited

U.S. PATENT DOCUMENTS

| | | | |
|---|---|---|---|
| 2,665,906 | 1/1954 | Johnson | 271/125 |
| 3,108,801 | 10/1963 | Dalen | 271/122 |
| 3,460,826 | 8/1969 | Porth | 271/37 |
| 3,612,513 | 10/1971 | Godlewski | 271/251 |
| 3,720,408 | 3/1973 | Horn | 271/145 |
| 3,827,687 | 8/1974 | Kono | 271/162 |
| 3,961,786 | 6/1976 | Yanker | 271/122 |
| 4,060,232 | 11/1977 | Gibson | 271/122 |
| 4,073,391 | 2/1978 | O'Brien et al. | 271/246 |
| 4,284,269 | 8/1981 | Ignatjev | 271/122 |
| 4,420,747 | 12/1983 | Kistner | 271/263 |
| 4,556,209 | 12/1985 | Tusho | 271/122 |

FOREIGN PATENT DOCUMENTS 1889032 10/1963 Fed. Rep. of Germany .

OTHER PUBLICATIONS

Xerox Disclosure Journal, "A Paper Registration Mechanism", vol. 4, No. 4, Jul./Aug. 1979.

*Primary Examiner*—John W. Caldwell, Sr.
*Assistant Examiner*—Alvin Oberley
*Attorney, Agent, or Firm*—Cushman, Darby & Cushman

[57] ABSTRACT

In a document feeding apparatus, a document table carrying documents is provided with a stopper plate. The stopper plate can move between a stop position to retain the documents on the document table and a release position to allow the documents on the document table to move by the force of gravity. A first guide plate to guide the forward edges of the documents is provided on the lower-course side of the document table with respect to the document feeding direction. An obtuse angle is formed between the plane containing the first guide plate and the plane containing the document table. The forward edges of the documents transferred from the document table are guided by the first guide plate so that they are trued up in an oblique manner. On the document feeding side of the guide plate intake rollers are arranged which pick up and deliver, one by one, the documents guided by the guide plate in an orderly manner. The intake rollers are coupled to a first drive mechanism, and are rotated thereby in one direction to pick up the documents.

20 Claims, 23 Drawing Figures

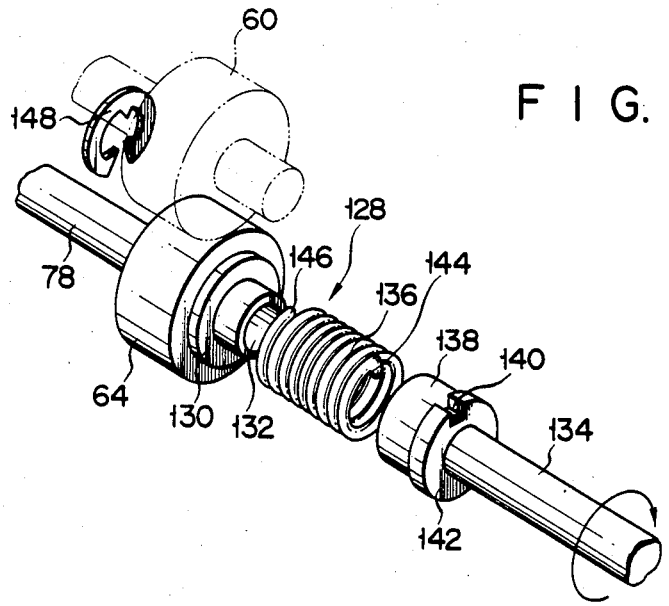
FIG. 8
FIG. 9
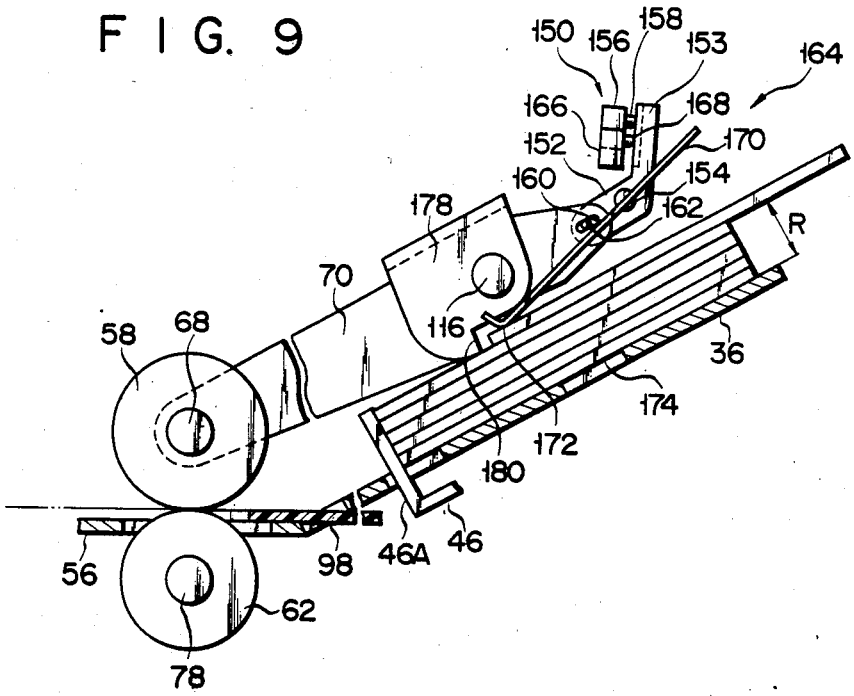

SHEET FEEDING APPARATUS

This is a continuation of application Ser. No. 479,848, filed Mar. 28, 1983, which was abandoned upon the filing hereof.

BACKGROUND OF THE INVENTION

This invention relates to an apparatus for feeding sheets, more specifically to an apparatus for continuously separating and feeding the uppermost sheet of a plurality of sheets.

An apparatus which stores many thin sheets made of, e.g., paper, metal or plastic, and separately feeds the stored sheets one by one is generally known.

For example, a copying apparatus is provided with an automatic original document feeding apparatus as the sheet feeding apparatus in which original documents to be copied are automatically separated one by one when they are stored collectively in a storage chamber, and are then fed toward a copying table.

As shown in FIGS. 1 and 2, a prior art sheet feeding apparatus has an original document table 4 to carry a stack of original documents 2. Since the original document table 4 is slanted, the original documents 2 are moved toward the region between feeding rollers 6 and a separating roller 8 by the force of gravity. The feeding rollers 6 and the separating roller 8 are rotated clockwise as indicated by arrows in FIG. 1. The feeding rollers 6 are in contact with the upper surface of the uppermost original document 2*a*, while the separating roller 8 is in contact with the lower surface of another original document or the lower surface of the lowest of two or more other original documents 2*b*. As shown in FIG. 2, the separating roller 8 lines halfway between the two feeding rollers 6 in a offset manner. The uppermost document 2*a* in contact with the feeding rollers 6 is delivered in the feeding direction as the feeding rollers 6 rotate, while the other original document 2*b*, in contact with the separating roller 8, is returned.

Although the forward edges of the documents 2 on the document table 4 are trued up once, they may sometimes become irregular when the documents 2 are inserted between the feeding rollers 6 and the separating roller 8 directly from the original paper table 4. Thus, some documents under the uppermost document 2*a* may come into contact with the feeding rollers 6 before the uppermost original document 2*a* does. As a result, the upper-most document 2*a* may not be fed first, and so, the documents may not be fed in the proper order.

SUMMARY OF THE INVENTION

The object of this invention is to provide a sheet feeding apparatus capable of reliably feeding sheets on a sheet table one by one, starting with the uppermost sheet.

According to an aspect of the invention, there is provided an apparatus for feeding sheets which comprises a sheet table on which the sheets are set in a stack, the sheet table having a slanting carrying surface for making the sheets slide downward by the force of gravity, stop means movable between a stop position where the stop means retains the sheets on the carrying surface and a release position where the stop means allows the sheets to move down along the carrying surface by the force of gravity, first drive means for moving the stop means between the stop position and the release position, guide means having a guide surface to guide the forward edges of the sheets moved down along the carrying surface in a predetermined direction when the stop means is located in the release position by the first drive means, the carrying surface and the guide surface making an obtuse angle, pickup means coming into contact with the sheet guided by the guide means to pick up and deliver each sheet one by one, and second drive means for driving the pickup means.

BRIEF DESCRIPTION OF THE DRAWINGS

FIG. 8 is a disassembled perspective view of a power transmission mechanism used in the sheet feeding apparatus of FIG. 3;

FIG. 9 is a sectional side view schematically showing an overset preventing member;

DETAILED DESCRIPTION OF THE PREFERRED EMBODIMENT

Referring now to FIGS. 3 to 23, an embodiment of this invention will be described in detail.

Figure 1:
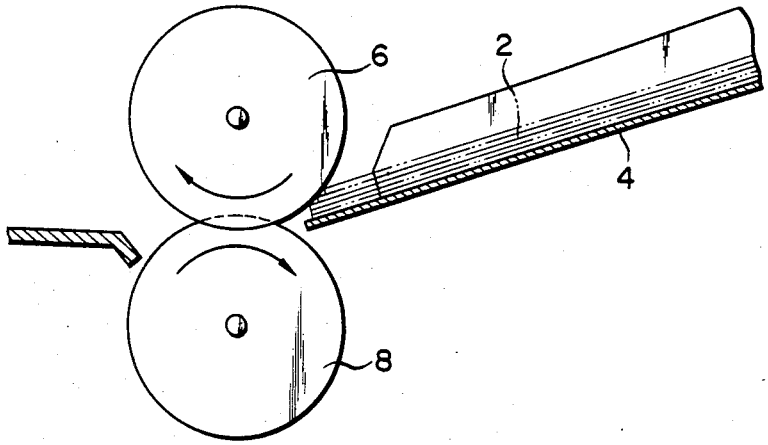
FIG. 1 (PRIOR ART)
FIG. 1 is a schematic side view of a prior art sheet feeding apparatus.
Figure 2:
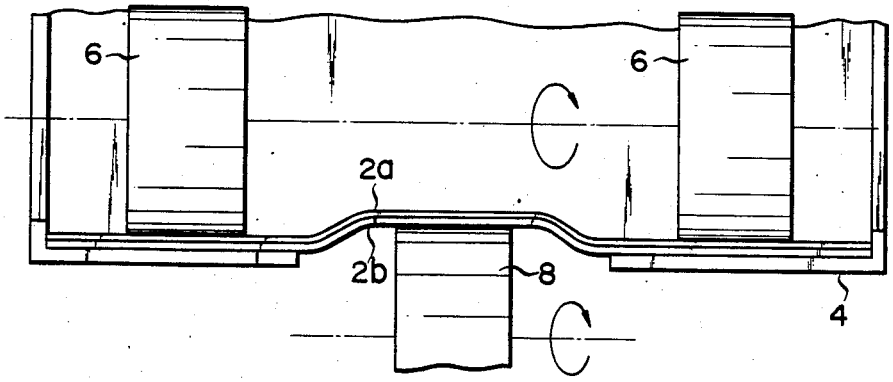
FIG. 2 (PRIOR ART)
FIG. 2 is a schematic front view of the sheet feeding apparatus of FIG. 1.
Figure 3:
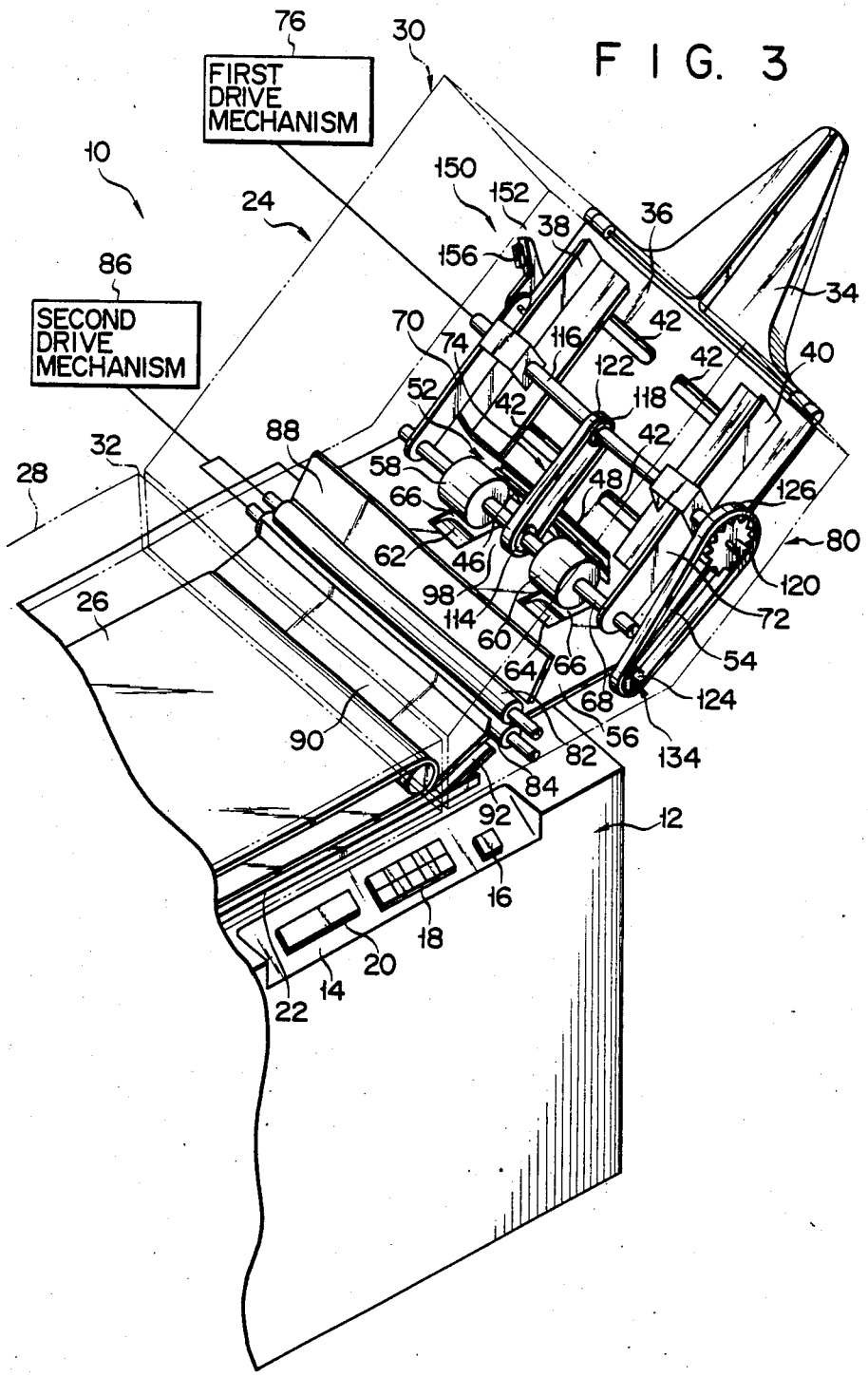
FIG. 3 is a perspective view schematically showing a sheet feeding apparatus according to an embodiment of this invention used in a copying apparatus.

As shown in FIG. 3, a copying apparatus is provided with a body 12 having a copying function. A control panel 14 is formed at one side portion of the upper surface of the body 12. The control panel 14 includes a start button 16, control buttons 18, and a display panel 20 for indicating prescribed information. An exposure table 22 is provided on the upper surface of the housing 12. An original document to be copied is placed on the exposure table 22. An automatic original document feeder 24 for automatically delivering the original document to the exposure table 22 is provided over the exposure table 22. The automatic document feeder 24, as indicated by a two-dot chain line in FIG. 3, comprises a base 28 including a document feeding belt 26 over the exposure table 22, and a document feeding apparatus 30 for feeding a stack of original documents thereon toward the document feeding belt 26. The document feeding apparatus 30 corresponds to the sheet feeding apparatus of this invention. The document feeding apparatus 30 is swingably mounted on one end of the base 28 by means of a coupling portion 32 (to be described later) so as to be able to overlie the base 28. In manually feeding each original document onto the exposure table 22 by means of the document feeding belt 26, the document feeding apparatus 30 is swung down onto the base 28. In automatically feeding the documents onto the exposure table 22 by means of the document feeding belt 26, on the other hand, the document feeding apparatus 30 is swung up from the base 28 around the coupling portion 32 to be set as shown in FIG. 3.

The document feeding apparatus 30 is provided with a first support member 34 for supporting several elements constituting the apparatus 30. An original document table 36 is laid on the first support member 34 to carry a plurality of documents in a pile. The document table 36 is angled down in the feeding direction so that the documents thereon travel in the feeding direction by their own weight. The document table 36 is provided with a pair of regulating plates 38 and 40 which regulate the position of the document from both sides thereof along the feeding direction to guide the same. Also, the document table 36 defining a carrying plane has a plurality of first grooves 42 extending at right angles to the document feeding direction. The regulating plates 38 and 40 individually engage the first grooves 42, and can slide at right angles to the document feeding direction to match the size of the original document on the document table 36. A stopper plate 46 is provided below the regulating plates 38 to retain a stack of original documents 44 (FIG. 4) on the document table 36. The extreme end of the stopper plate 46 projects above the document table 36 through a first opening 48 in the table 36. The stopper plate 46 is coupled to a stop mechanism 50 (FIG. 6) mentioned later to be operated thereby.

Figure 4:
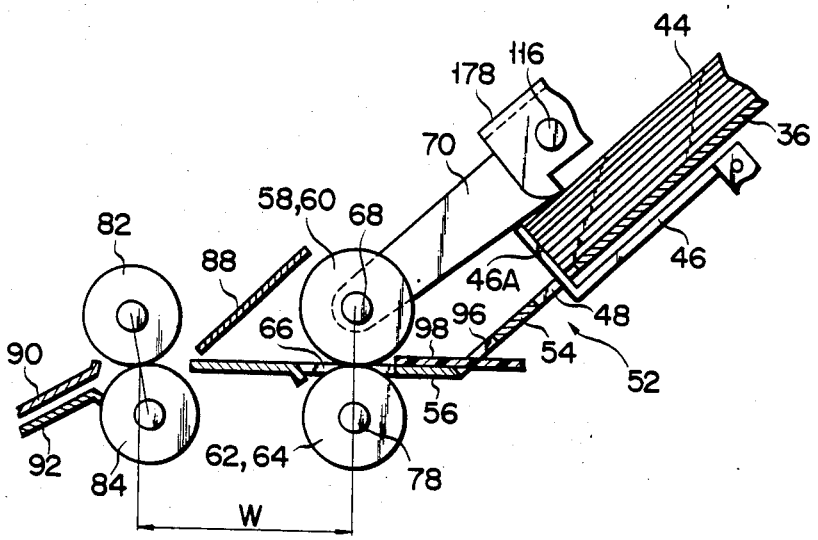
FIG. 4 is a sectional side view schematically showing the principal part of the sheet feeding apparatus of FIG. 3.

As shown in FIGS. 3 and 4, a guide portion 52 for guiding the documents is provided at the lower end portion of the document table 36 so as to be integral therewith. The guide portion 52 includes a slanting plate 54 extending integrally from the document table 36 and a first guide plate 56 extending in a substantially horizontal manner from the slanting plate 54 to define a guide plane. The first guide plate 56 has second openings 66 through which intake rollers 58 and 60 and separating rollers 62 and 64 (to be mentioned later) are in rolling contact, respectively. The two intake rollers 58 and 60 which are located above the first guide plate 56 pick up a document fed from the document table 36, and then deliver it along the first guide plate 56. The surfaces of the intake rollers are formed of a material with high coefficient of friction, e.g., natural rubber. Thus, the intake rollers 58 and 60 can securely pick up the documents 44 (FIG. 4) when they touch the same. The intake rollers 58 and 60 are coaxially mounted in series on a first shaft 68 extending at right angles to the document feeding direction. The first shaft 68 is rockably supported at both end portions individually by second arms 70 and 72 to be mentioned later. The first shaft 68 is coupled to a first drive mechanism 76 including a motor (not shown) by means of a first transmission mechanism 74, to be mentioned later. In this embodiment, the intake rollers 58 and 60 are rotated in the direction of an arrow T (FIG. 7) at a speed of approximately 10 mm/sec. The separating rollers 62 and 64 are located under the intake rollers 58 and 60, respectively, so as to be able to come into contact therewith. The separating rollers 62 and 64 are coaxially mounted in series on a second shaft 78 (FIG. 4) extending parallel to the first shaft 68. The separating rollers 62 and 64 are formed of a wear-resistant material, e.g., urethane rubber of 80-degree hardness. Since the surfaces of the separating rollers 62 and 64 are polished, they are protected against the adhesion of paper dust and enjoy satisfactory durability. As shown in FIG. 3, one end portion of the second shaft 78 is coupled to the first drive mechanism 76 by means of a second transmission mechanism 80. A rotatory force in the direction of arrow U (FIG. 7) is applied to the separating rollers 62 and 64 by means of the first transmission mechanism 74 and a third transmission mechanism 128.

A pair of feeding rollers 82 and 84 face each other adjoining one end of the first guide plate 56 on the lower-course side thereof with respect to the document feeding direction. The feeding rollers 82 and 84 can rotate in their respective directions to deliver the documents toward the exposure table 22. The feeding rollers 82 and 84 are coupled to a second drive mechanism 86 for driving the same. Also, the second drive mechanism 86 is coupled to the stop mechanism 50, to be mentioned later. The second drive mechanism 86 includes a control mechanism (not shown) controlled in conjunction with the operation of the document feeding belt 26. That is, until the exposure of the original document carried onto the exposure table 22 by the document feeding belt 26 is ended, the second drive mechanism 86 temporarily stops the drive of the feeding rollers 82 and 84 to suspend the feeding of the next original document to the exposure table 22. In this embodiment, the feeding rollers 82 and 84 are rotated at a peripheral speed about three times that of the intake rollers 58 and 60. Between the feeding rollers 82 and 84 and the intake rollers 58 and 60, a second guide plate 88 to guide the documents delivered from the intake rollers 58 and 60 overlies the first guide plate 56. The second guide plate 88 is angled down from the intake rollers 58 and 60 toward the feeding rollers 82 and 84. Third and fourth guide plates 90 and 92 to guide the documents are provided between the feeding rollers 82 and 84 and the original documents feeding belt 26, and are arranged so as to hold therebetween each document delivered from the feeding rollers 82 and 84 from both upper and lower sides of the paper.

Figure 5:
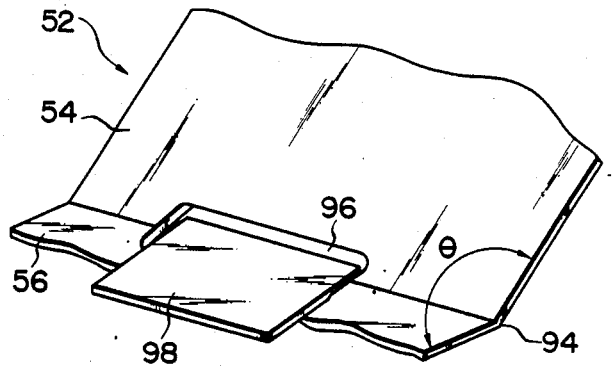
FIG. 5 is a perspective view of a guide portion shown in FIG. 4.

Referring now to FIG. 5, the guide portion 52 for guiding the documents will be described further in detail. A third opening 96 is formed at a bent portion 94 dividing the slanting plate 54 and the first guide plate 56 that are integral. A sliding plate 98 is laid on the first guide plate 56, having one end portion thereof inserted in the third opening 96. The sliding plate 98 is formed of a plastic film with a low coefficient of friction, e.g., Mylar (Trademark). The angle $\theta$ between the slanting plate 54 and the first guide plate 56 or the sliding plate 98 is an obtuse angle, that is, an angle greater than 90° and smaller than 180°. Preferably, in this embodiment, the angle $\theta$ ranges from 105° to 150°. Thus, the documents from the document table 36 are fed one by one, from the uppermost paper on the stack. At the same time, the documents slide on the first guide plate 56 toward the intake rollers 58 and 60.

Figure 6:
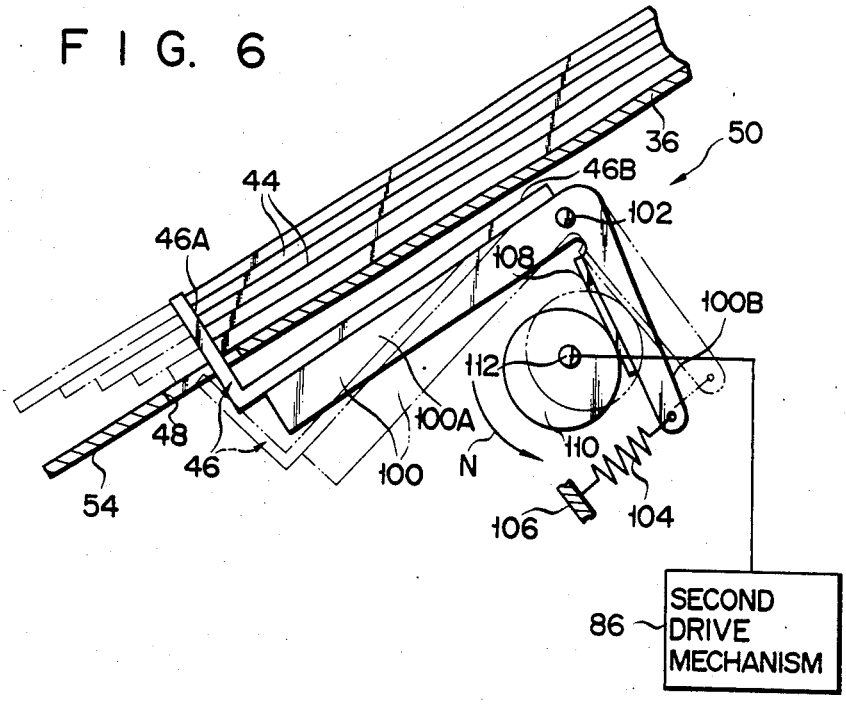
FIG. 6 is a side view schematically showing a stop mechanism shown in FIG. 3.
Figure 7:
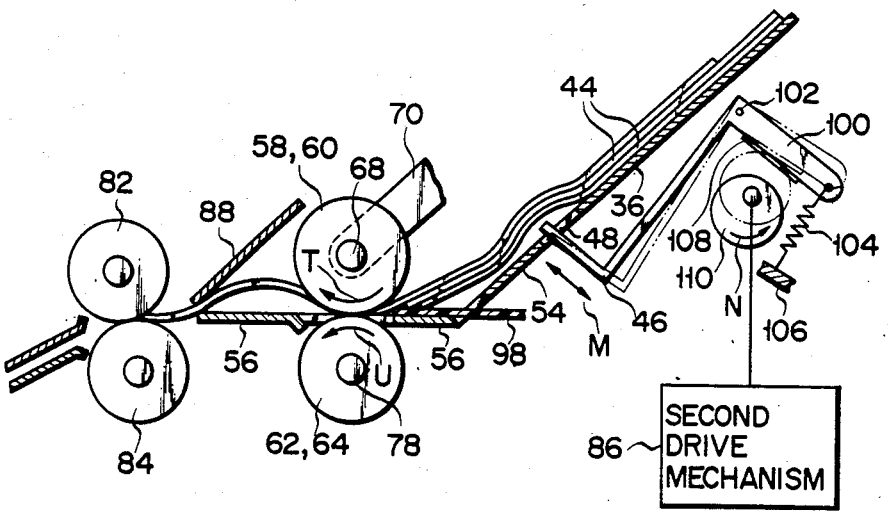
FIG. 7 is a sectional side view schematically showing the sheet feeding apparatus for illustrating the operation of the stop mechanism shown in FIG. 6.

Referring now to FIGS. 6 and 7, the stop mechanism 50 will be described in detail. The stopper plate 46 has an L-shaped cross section. A projected strip 46A corresponding to one side of the L-shaped structure can project above the document table 36 through the first opening 48. The other side 46B of the L-shaped structure or the stopper plate 46 is attached to one side 100A of a first arm 100 with an L-shaped cross section. The first arm 100 is swingably mounted on a shaft 102 at its bent portion. One end of a spring 104 having a given urging force is attached to the end portion of the other side 100B of the L-shaped structure of the first arm 100. The other end of the spring 104 is fixed to a second support member 106. A pad 108 is pasted on the other side 100B. An eccentric cam 110 rotatable in the direction of an arrow N adjoins the pad 108. The eccentric cam 110 has a circular cross section, and is fixed to a cam shaft 112 which is eccentric to the center of the circular cross section. The cam shaft 112 is coupled to the second drive mechanism 86 to rotate the same in the direction of arrow N. In this embodiment, the eccentric cam shaft 112 makes two or three revolutions per second. The urging force of the spring 104 surpasses the total weight of several original documents (five or six in this embodiment), but will be surpassed by any greater weight. Thus, when the eccentric cam 110 is rotated so as to approach the pad 108, the first arm 100 presses the stopper plate 46 downward against the urging force of the spring 104.

If there are more than five or six original documents on the document table 36, however, they will slide smoothly by the force of gravity. Since the total weight of the documents on the document table 36 surpasses the urging force of the spring 104, the projected strip 46A of the stopper plate 46 is depressed below the surface level of the document table 36. In this state, the eccentric cam 110 is not in contact with the pad 108, as indicated by a two-dot chain line in FIG. 7.

If the documents 44 on the document table 36 are six or less in number, then the urging force of the spring 104 surpasses the total weight of the documents. Accordingly, the projected strip 46A is periodically projected above the document table 36 through the second opening 66 as the eccentric cam 110 rotates. When the eccentric cam 110 approaches the pad 108, it touches and presses the pad 108 to swing the first arm 100 to the position indicated by the two-dot chain line. Namely, the projected strip 46A is moved below the document table 36. If the original documents on the document table 36 are five or six in number, therefore, the projected strip 46A is reciprocated as indicated by an arrow M in FIG. 7. As a result, documents 44 swing up and down and slide one after another on the sliding plate 98 toward the intake rollers 58 and 60. Thus, even several documents can be smoothly led to the intake rollers 58 and 60.

Referring now to FIG. 3 the first transmission mechanism 74 for transmitting the driving force of the first drive mechanism 76 to the first shaft 68 will now be described. A first sprocket 114 is mounted on the middle portion of the first shaft 68 by means of a one-way clutch (not shown). Over the document table 36, a third shaft 116 is rotatably supported between the second and third arms 70 and 72. In other words, the second and third arms 70 and 72 are rockable around the third shaft 116. A second sprocket 118 is mounted on the middle portion of the third shaft 116. One end portion of the third shaft 116 is connected with the first drive mechanism 76 which rotates the shaft 116 in one direction. The other end portion of the third shaft 116 is connected with the second transmission mechanism 80. The second transmission mechanism 80 is provided with a third sprocket 120 which is attached to the other end portion of the third shaft 116. A chain (not shown) is passed over the first and second sprockets 114 and 118 in an engaging manner. This chain is covered with a first cover member 122. A fourth sprocket 124 is mounted on that end of the second shaft 78 which is opposed to the third sprocket 120. A chain (not shown) is passed over the fourth and third sprockets 124 and 120 in an engaging manner. This chain is covered with a second cover member 126. Thus, the driving force is transmitted through the first transmission mechanism 74 to the first shaft 68 supporting the intake rollers 58 and 60 and the second shaft 78 supporting the separating rollers 62 and 64.

Referring now to FIG. 8, the third transmission mechanism 128 for transmitting the driving force of the first drive mechanism 76 to the separating rollers 62 and 64 will now be described in detail.

The third transmission mechanism 128 includes a plastic roller boss 130 which is mounted on the one end portion of the second shaft 78 bearing the one separating roller 64. The roller boss 130 is provided with a cylindrical projection 132 which extends along the axis of the roller boss 130. A fourth shaft 134 extends in alignment with the second shaft 78. The second shaft-side end of the fourth shaft 134 is fixedly fitted with a third support member 138 capable of engaging a spring 136 mentioned later. The third support member 138 has a flange 142 formed with a cut 140. The spring 136 is disposed between the projection 132 and the third support member 138 to connect the same. One end portion 144 of the spring 136 is fixed to the third support member 138 when it engages the cut 140 of the support member 138. The other end portion 146 of the spring 136 is in frictional engagement with the outer peripheral surface of the projection 132 to press on the same. Thus, a frictional force is produced between the other end portion 146 of the spring 136 and the projection 132, and torque applied to the fourth shaft 134 through the medium of the frictional force is transmitted to the roller boss 130. Moreover, the second shaft 78 is fitted with a snap ring 148 in the vicinity of the separating roller 64 for restraining the roller boss 130 from moving to the side of the second shaft 78.

Figure 14:
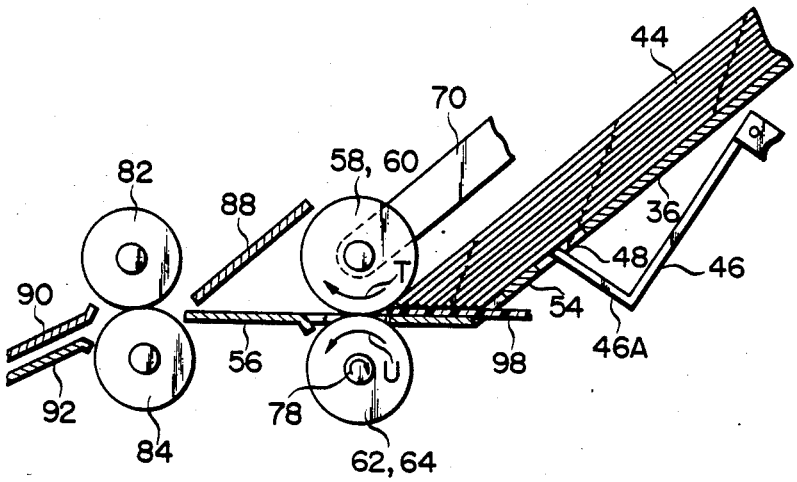

When the uppermost document 44A out of the stack of original documents 44 is not entirely held between the intake rollers 58 and 60 and the separating rollers 62 and 64, as shown in FIG. 14, the intake rollers 58 and 60 are brought into contact with the separating rollers 62 and 64, respectively, by the third transmission mechanism 128. At this time, therefore, the rotatory force of the intake rollers 58 and 60 is transmitted to the separating rollers 62 and 64 by the frictional force at the contact regions between the rollers. Since this frictional force is greater than the frictional force between the spring 136 and the projection 132 of the roller boss 130, the spring 136 slips on the projection 132 to alow the rotatory force of the intake rollers 58 and 60 to be transmitted to the separating rollers 62 and 64. Thus, the separating rollers 62 and 64 rotate in the direction of an arrow U in FIG. 14.

Figure 15:
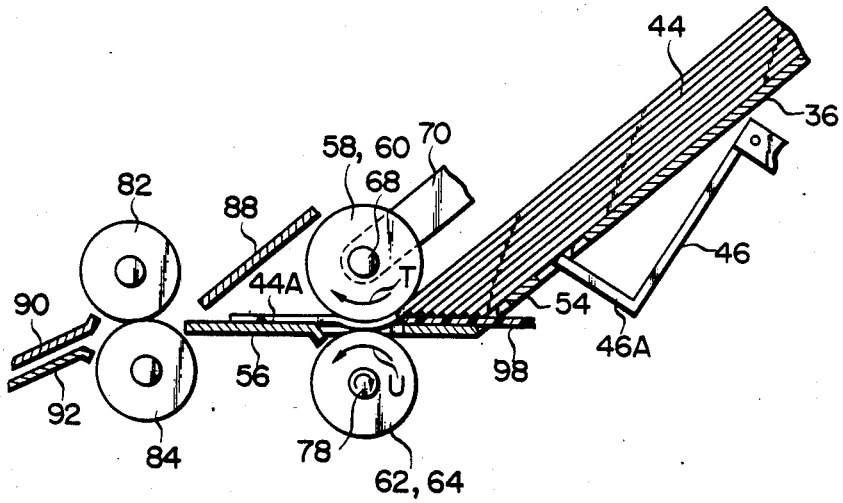

If only a single document is held between the intake rollers 58 and 60 and the separating rollers 62 and 64, as shown in FIG. 15, the separating rollers 62 and 64 are rotated in the direction of arrow U. This is because the sum of the frictional forces between the document and the separating rollers 62 and 64 and between the document and the intake rollers 58 and 60 is sufficiently greater than the frictional force between the spring 136 and the projection 132 of the roller boss 130 to allow the rotatory force of the intake rollers 58 and 60 to be transmitted to the separating rollers 62 and 64.

Figure 20:
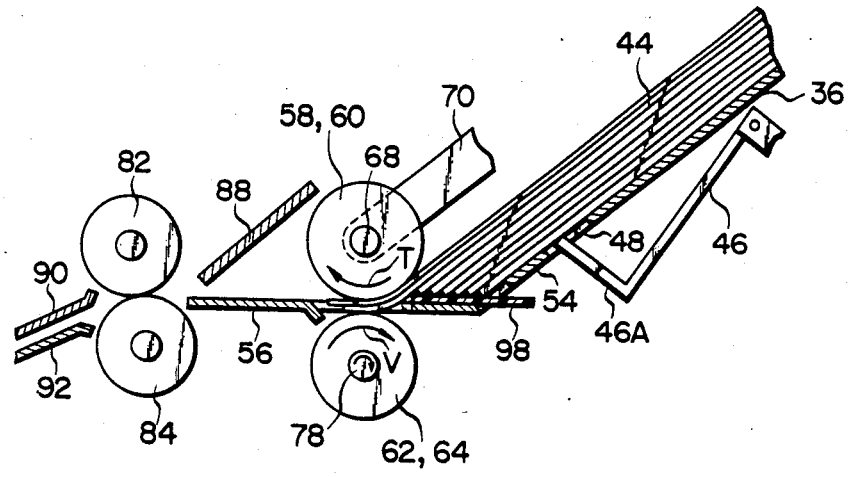
FIGS. 20 to 23 are sectional side views illustrating the way a plurality of original documents picked up by the intake rollers are separated.

If a plurality of documents are held between the intake rollers 58 and 60 and the separating rollers 62 and 64, frictional forces among the individual documents exist between the separating rollers 62 and 64 and the intake rollers 58 and 60. In this case, the frictional force between the spring 136 and the projection 132 of the roller boss 130 is greater than the sum of the frictional forces between the documents. Accordingly, the rotatory force transferred through the spring 136 is transmitted to the separating rollers 62 and 64. Thus, the separating rollers 62 and 64 are rotated in the direction of an arrow V (FIG. 20).

Figure 10:
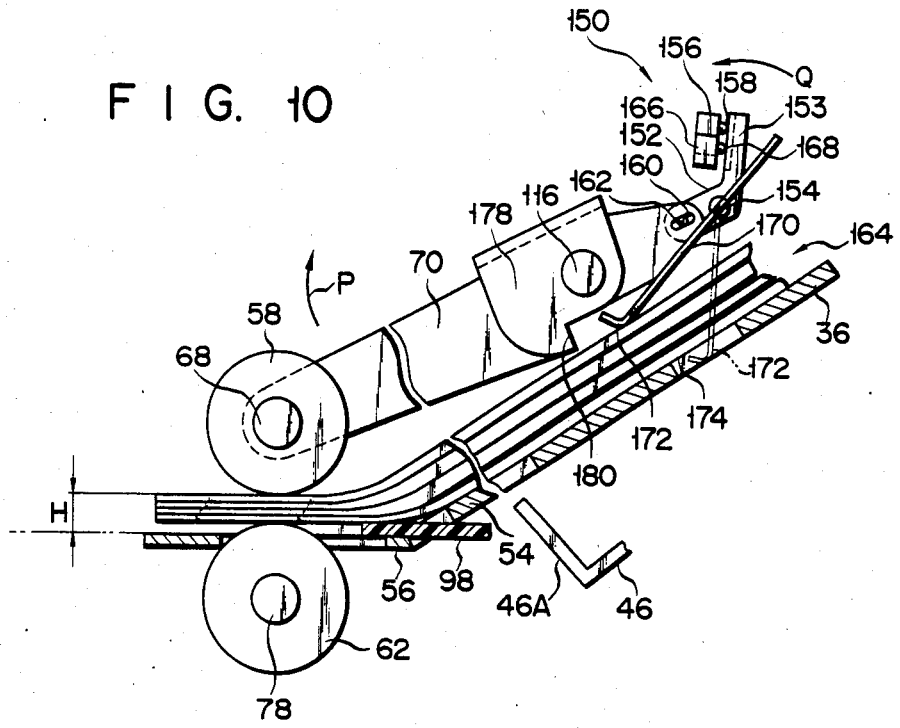
FIG. 10 is a sectional side view schematically showing sensing means for detecting pickup of excessive sheets by intake rollers.

Referring now to FIGS. 3, 9 and 10, a sensing mechanism for preventing an unmanageable number of documents from being set at one time on the document table 36 will be described.

A fourth arm 152 is coupled to the other end of the second arm 70 which supports the first shaft 68. The fourth arm 152 has an L-shaped cross section, and is swingable mounted on a fifth shaft 154 at its bent portion. A first microswitch 156 adjoins one end portion 153 of the fourth arm 152. The first microswitch 156 includes a first switch member 158. When the first switch member 158 is depressed, the first microswitch 156 is activated to cause the display panel 20 to indicate the message "PICKUP ERROR" by the agency of a control mechanism (not shown). An elongate second groove 160 is formed at the other end portion of the fourth arm 152. The second and fourth arms 70 and 152 are coupled by a sixth shaft 162 through the medium of the groove 160. Thus, if the intake rollers 58 and 60 pick up too many documents for the separating rollers 62 and 64 to separate, then the second arm 70 is rotated in the direction of an arrow P according to the total thickness H of the documents. As a result, the fourth arm 152 is swung in the direction of an arrow Q (FIG. 10) around the fifth shaft 154. When the total thickness H of the documents exceeds a predetermined value, the one end portion 153 of the fourth arm 152 presses the first switch member 158. Thereupon, the first microswitch 156 gives the display panel 20 a signal to indicate the message "PICKUP ERROR" through the control mechanism (not shown), as mentioned before.

A second sensing mechanism 164 for detecting the existence of the document(s) is arranged in parallel with the first sensing mechanism 150. In the second sensing mechanism 164, a second microswitch 166 is disposed parallel to the first microswitch 156. The second microswitch 166 includes a second switch member 168. When the second switch member 168 is depressed, the second microswitch 166 is activated to cause the display panel 20 to indicate the message "NO PAPER" by the agency of the control mechanism (not shown). A lever 170 is swingably mounted on the fifth shaft 154. One end portion 172 of the lever 170 is bent to be substantially L-shaped. The one end portion 172 of the lever 170 moves down by its own weight, and is located below the document table 36 through an opening 174 therein when no document is on the table 36. As a result, the other end portion 176 of the lever 170 presses the second switch member 168. Thereupon, the second microswitch 166 gives the display panel 20 a signal to indicate the message "NO PAPER" through the control mechanism (not shown).

As shown in FIG. 9, the third shaft 116 is mounted with an overset preventing member 178 for restricting the total thickness of the documents set on the document table 36. A restricting portion 180 is formed on the side of the overset preventing member 180 facing the original document table. The restricting portion 180 has a substantially right-angled stepped cross section. In setting the documents 44 on the slanted document table 36, therefore, if the total thickness of the original documents is greater than the length of the projection 46A of the stopper plate 46 above the document table 36, that is, the distance R between the restricing portion 180 and the document table 36, then the forward edges of the extra documents will abut against the restricting portion 180. Accordingly, the forward edges of the extra documents cannot reach the stopper plate 46, and are removed from the document table 36. Thus, the documents may be prevented from being overset on the document table 36.

Figure 11:
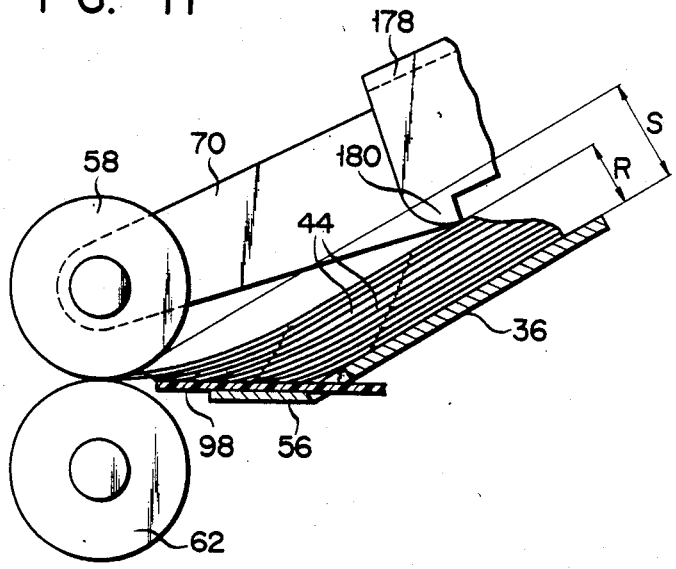
FIG. 11 is a sectional side view schematically showing the relative positions of the intake rollers, a first guide plate, and a slanting plate shown in FIG. 4.

As shown in FIG. 11, the distance R between the restricting portion 180 of the overset preventing mechanism 178 and the document table 36, that is, the permissible total thickness R of the documents on the table 36, is shorter than the distance S between the original paper table 36 and that one of the tangents to the intake roller 58 which is parallel to the table 36. Thus, the overset can be reliably prevented so that it is impossible for a plurality of documents to be picked up at a time.

Referring to FIGS. 12 to 22, the operation of the aforementioned embodiment will now be described.

Figure 12:
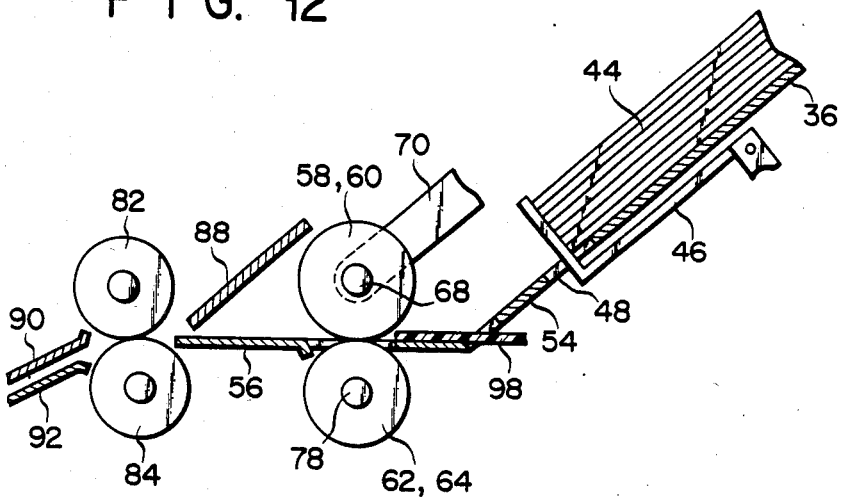
FIGS. 12 to 19 are sectional side views illustrating the operation of the principal part of the sheet feeding apparatus of FIG. 3.

As shown in FIG. 12, the stack of documents 44 is laid on the slanted document table 36. Then, the documents move on the document table 36 guided by the regulating plates 38 and 40 that are adjusted to the given paper size. As a result, the forward edges of the documents abut against the stopper plate 46. Thus, in this stop position, both the lateral sides and the forward edges of the original documents are retained and trued up.

When the documents are laid on the document table 36, the one end portion 172 of the lever 170 is force up, as shown in FIG. 9. As a result, the other end of the lever 170 leaves the second switch member 168 unpressed, so that the second microswitch 166 detects the existence of the documents. The stack of documents 44 on the document table 36 is stopped by the stopped plate 46 as it is inclined along the surface of the table 36.

If the total thickness of the documents put on the document table 36 is greater than the given thickness R, as shown in FIGS. 9 and 11, the overset preventing member 178 prevents the extra documents from being set in place. Thus, an operator can readily notice the overset. The operator is then expected to reset a smaller number of documents on the document table 36. In this manner, the overset of original documents can be prevented with high reliability.

Figure 13:
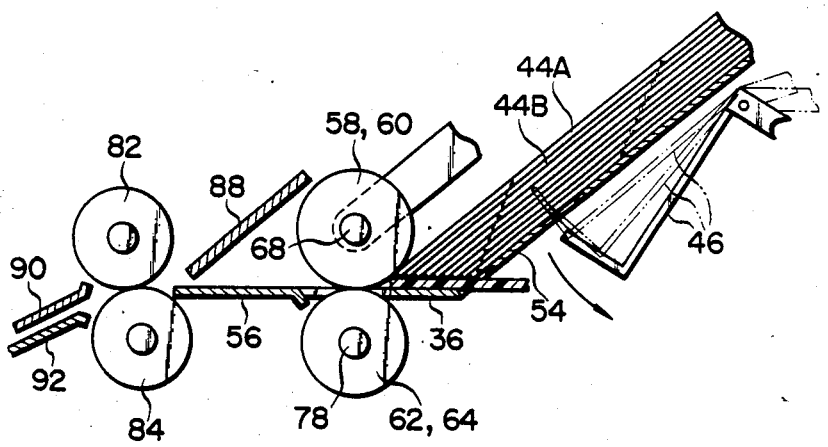

Subsequently, when the start button 16 (FIG. 3) is depressed, the second drive mechanism 86 is actuated to rotate the eccentric cam 110, as shown in FIG. 6. As the eccentric cam 110 rotates, the stopper plate 46 is moved down below the document table 36 through the first opening 48. Thus, the documents 44 on the document table 36, as shown in FIG. 13, are successively transferred step by step toward the substantially horizontal sliding plate 98 by the force of gravity, the uppermost document 44A on the stack coming first. When the forward edge of the uppermost document 44A touches the sliding plate 98, the document 44A slides on the sliding plate 98 by the force of inertia to come into contact with the intake rollers 58 and 60. When the documents 44 are transferred one after another from the document table 36, the respective forward edges of the documents 44 are trued up in an offest manner since the sliding plate 98 is at an angle to the slanting plate 54. Thus, the forward edge of the uppermost or first document 44A on the sliding plate 98 is located nearest to the intake rollers 58 and 60, while those of the second and third documents are successively located next to the intake rollers 58 and 60. Then, the forward edges of the original documents transferred on the sliding plate 98 successively come into contact with the intake rollers 58 and 60 to be picked up thereby, the uppermost document 44A coming first.

Then, the third shaft 116 is rotated with a time lag after the start button 16 is depressed, and the intake rollers 58 and 60 and the separating rollers 62 and 64 are rotated in the directions of arrow T and U, respectively, by the first transmission mechanism 74, as shown in FIG. 14.

Since the single document 44A is held between the intake rollers 58 and 60 and the separating rollers 62 and 64, as shown in FIG. 15, it is carried toward the feeding rollers 82 and 84 while the separating rollers 62 and 64 are rotated in the direction of arrow U.

Figure 16:
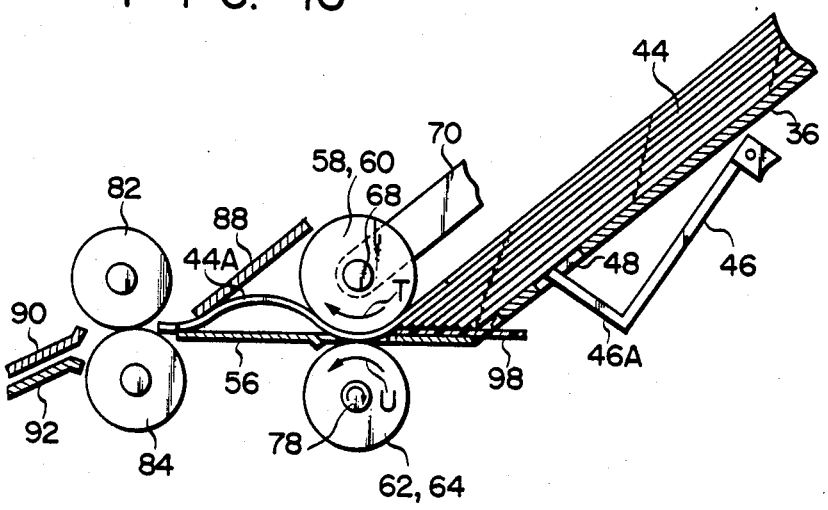
Figure 17:
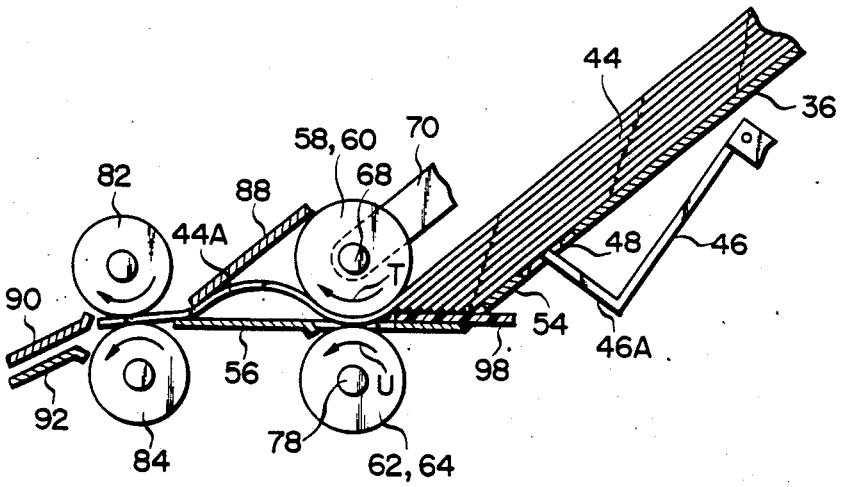
Figure 18:
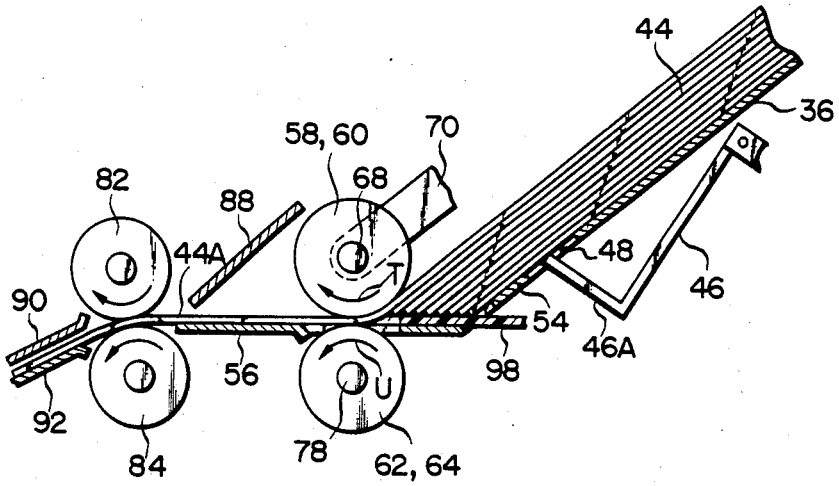
Figure 19:
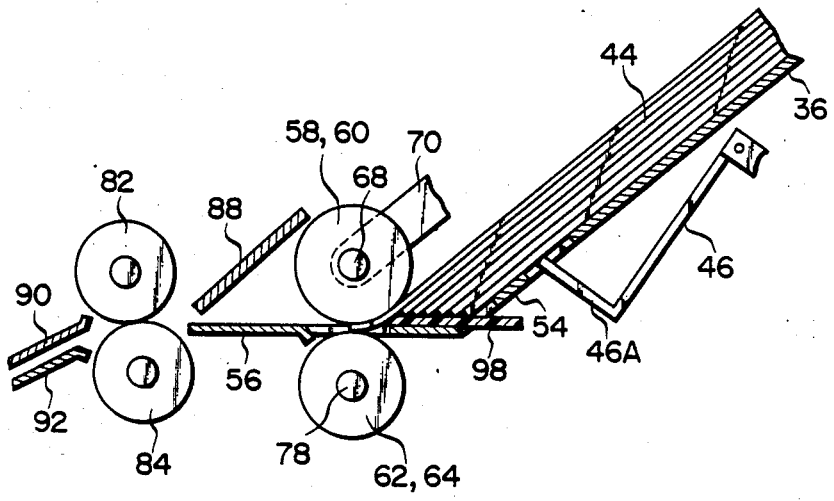

When the original document 44A is transferred over a given distance as the intake rollers 58 and 60 and the separating rollers 62 and 64 rotate, the forward edge of the original document 44A is inserted between the feeding rollers 82 and 84, as shown in FIG. 16. While the feeding rollers 82 and 84 are once stopped, the intake rollers 58 and 60 and the separating rollers 62 and 64 continue to deliver the document 44A toward the feeding rollers 82 and 84. As a result, the document 44A is curved. Owing to the elasticity of the curved document 44A, its forward edge abuts uniformly against the line at which the feeding rollers 82 and 84 are in contact with each other. The curving of the document 44A is restrained by the second guide plate 88.

The feeding rollers 82 and 84 are rotated clockwise and counterclockwise, relatively, and at a peripheral speed about three times that of the intake rollers 58 and 60, with a time lag after the forward edge of the document 44A is inserted between the feeding rollers 82 and 84 is timed in accordance with the copying apparatus 10. Also, the feeding rollers 82 and 84 are rotated simultaneously with the document belt 26 disposed in the copying apparatus 10. The peripheral speed of the feeding rollers 82 and 84 is substantially equal to that of the document feeding belt 26. Thus, the document 44A delivered to the feeding rollers 82 and 84 are transferred by the rotation of these rollers 82 and 84, and guided by the third and fourth guide plates 90 and 92 to reach the document feeding belt 26.

Meanwhile, the intake rollers 58 and 60 pick up the second document 44B (lying directly under the document 44A), and then the series of operations described above is repeated. Thus, the intake rollers 58 and 60 can pick up and feed the documents on after another, starting with the uppermost document 44A.

The document feeding belt 26 carries the document 44A delivered from the feeding rollers 82 and 84 onto the exposure table 22, thereby setting the document 44A in the predetermined copying position. Then, the document 44A is copied.

While the intake rollers 58 and 60 and the separating rollers 62 and 64 are not rotating, the second drive mechanism 86 is driven by the control mechanism (not shown), so that the stopper plate 46 is located below the lowermost document on the document table 36. When many documents (more than five or six in this embodiment) are on the document table 36, the stopper plate 46 is retained in the down position. When there is a smaller number of documents on the table 36, the stopper plate 46 reciprocates and abuts against the lowermost document.

Among the stack of documents on the document table 36, those documents at the lower portion of the stack are successively transferred toward the intake rollers 58 and 60 by the force of gravity. Some of the documents may, though not very often, be prevented from moving on the sliding plate 98 by friction caused by static electricity or a variation in paper quality. However, if the stopper plate 46 pushes the lowermost document on the document table 36, the documents are urged to move toward the intake rollers 58 and 60. Once the documents come to a standstill on the sliding plate 98, a great static frictional force is produced between the documents and the sliding plate 98. Once the documents start moving on the sliding plate 98, however, dynamical frictional force acts on them. Accordingly, if the stopper plate 46 pushes the lowermost document to move it slightly, then all the documents on the document table 36 will move on the sliding plate 98 to be picked up by the intake rollers 58 and 60.

The documents on the document table 36 may very rarely fail to be separated from one another due to variations in quality, high frictional resistance, or the generation of static electricity. Namely, a plurality of documents may be inserted at a time between the intake rollers 58 and 60 and the separating rollers 62 and 64.

As shown in FIG. 20, for example, two documents may be simultaneously inserted between the intake rollers 58 and 60 and the separating rollers 62 and 64. In this case, the frictional resistance between these two documents and the individual rollers 58, 60, 62 and 64 is higher than that between the documents. Since the separating rollers 62 and 64 are always urged to rotate in the direction of the arrow V by the third transmission mechanism 128 (FIG. 8), the rotatory force in the direction of the arrow V surpasses the frictional force between the documents to rotate the separating rollers 62 and 64 in the direction of the arrow V. Namely, the separating rollers 62 and 64 are rotated in the direction to return the document in contact therewith.

On the other hand, the intake rollers 58 and 60 are rotated in the direction of the arrow T to feed the document in contact therewith. Thus, even if two documents are inserted between the intake rollers 58 and 60 and the separating rollers 62 and 64, the rotation of these rollers ensures orderly feeding of the documents.

Figure 21:
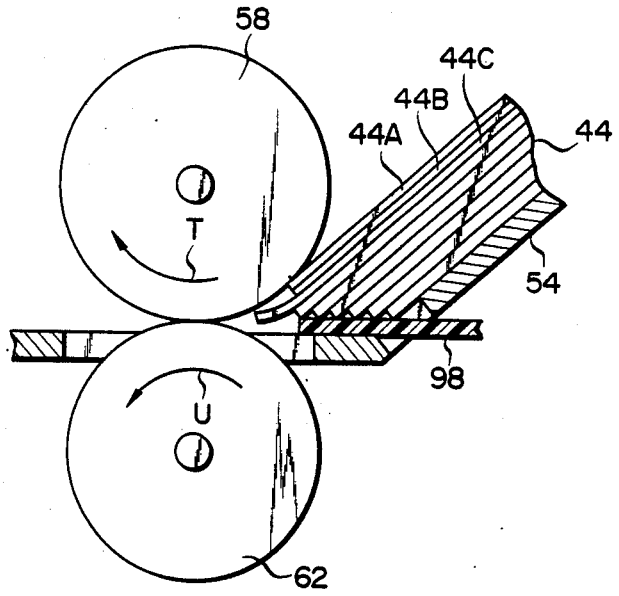
Figure 22:
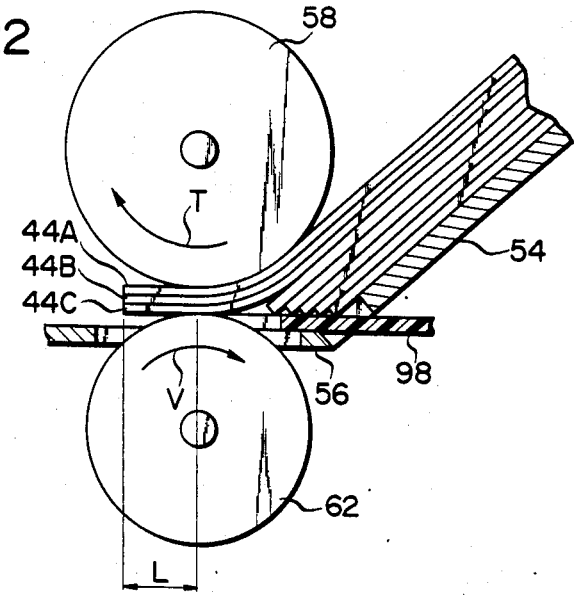
Figure 23:
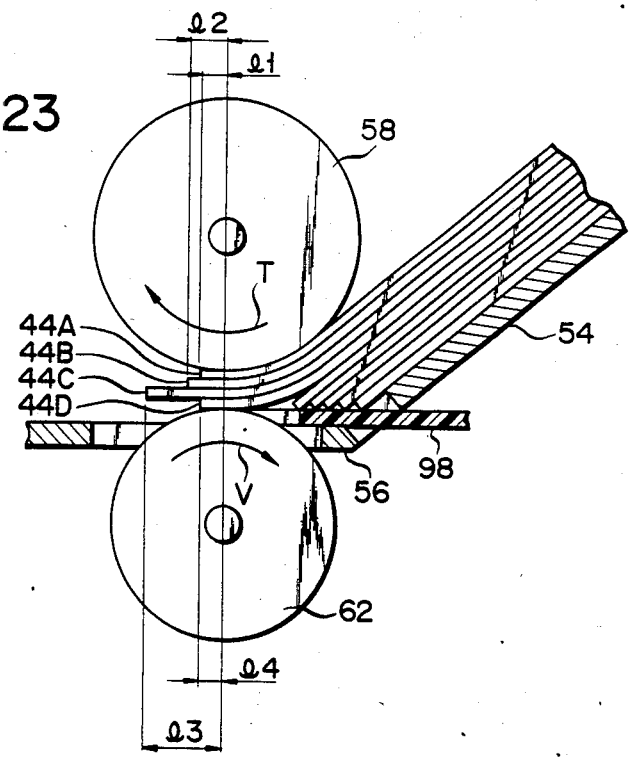

Referring to FIGS. 21 to 23, the way in which three or more original documents between the intake rollers 58 and 60 and the separating rollers 62 and 64 are separated will now be described.

The forward edges of the first, second and third documents 44A, 44B and 44C, out of the stack of documents 44, may not be trued up, as shown in FIG. 21. In this case, the document 44C is first inserted between the intake rollers 58 and 60 and the separating rollers 62 and 64 to be carried forward. Then, the first or uppermost document 44A touches the intake rollers 58 and 60 to be transferred by frictional force. The document 44A transmits conveying force to the adjoining document 44B via the frictional .force between them, thereby transferring the document 44B in the said direction.

However, the separating rollers 62 and 64 are urged to rotate in the direction of arrow V by the third transmission mechanism 128. When the rotatory force in the direction of arrow V is transmitted through the separating rollers 62 and 64 to the document 44C, the documents 44C and 44B are successively returned since the frictional force between the document 44C and the separating rollers 58 and 60 is greater than that between the documents 44B and 44C.

In this embodiment, the peripheral speed of the separating rollers 62 and 64 is about three times that of the intake rollers 58 and 60. Therefore, if the document 44A in contact with the intake rollers 58 and 60 advances 10 mm after the instant that the documents 44A, 44B and 44C are fed together or the instant that the documents start to be separated, then the document 44C in contact with the separating rollers 62 and 64 will be returned approximately 30 mm.

Here let us suppose that the distances from the contact portion between the intake rollers 58 and 60 and the separating rollers 62 and 64 to the forward edges of the documents 44B and 44C at the instant that the documents start to be separated are L and X, respectively. If X is 30 mm or less, the document 44B in contact with the document 44C is quickly returned by the distance L−X. As this action is repeated, the documents 44B and 44C are fed back and separated. When the separating rollers 62 and 64 touch the document 44A, that is, when only the document 44A is left between the intake rollers 58 and 60 and the separating rollers 62 and 64, the sum of the frictional forces between the document 44A and the separating rollers 62 and 64 and between the document 44A and the intake rollers 58 and 60 is greater than the rotatory force in the direction of arrow V transmitted through the third transmission mechanism 128, as mentioned before. Thus, the rotatory force of the intake rollers 58 and 60 transmitted through the document 44A to the separating rollers 62 and 64 surpasses the rotatory force in the direction of arrow V transmitted through the third transmission mechanism 128, so that the separating rollers 62 and 64 are rotated in the direction of arrow U. Thus, the document 44A is transferred in the feeding direction.

The separating capability of the separating rollers 62 and 64 may be expressed as follows:

$$3(W-l_1)>l_2+l_3+\ldots+l_N$$

where W (FIG. 4) is the distance from the center line connecting the axes of the intake rollers 58 and 60 and the separating rollers 62 and 64 to the contact portion between the feeding rollers 82 and 84, l (FIG. 23) is the distance from the center line to the forward edge of each of the documents held in layers between the intake rollers 58 and 60 and the separating rollers 62 and 64, $V_F$ is the peripheral speed of the intake rollers 58 and 60, $V_B$ is the peripheral speed of the separating rollers 62 and 64, and $3V_F=V_B$. Thus, the number of separable documents is N which satisfies the above equation.

If more than N number of documents are inserted between the intake rollers 58 and 60 and the separating rollers 62 and 64, the message "PICKUP ERROR" is indicated on the display panel 20 by the first sensing mechanism 150, and the drive is stopped.

According to this embodiment, the document table is disposed at an angle to the guide plate (or sliding plate). Accordingly, the document table can carry 80 to 100 documents without affecting the satisfactory separating and feeding operations, as compared with the limited loading capacity of 20 to 30 sheets of the prior art document table.

This invention is not limited to the one embodiment described above, various changes and modifications may be made within the scope or spirit of the invention.

In the above embodiment, the apparatus of the invention has been described as an original document feeding apparatus used in a copying apparatus. However, the sheet feeding apparatus of the invention may also be used with the same effect in an automatic banking machine which accepts stacks of bank notes.

In the aforementioned embodiment, moreover, the slanting plate and the first guide plate form an obtuse angle. Alternatively, an additional flat plate may be provided between the slanting plate and the first guide plate, or the intersection of the two plates may be arcuated.

The intake rollers and the separating rollers may be replaced with belts for the same purpose.

What is claimed is:

1. An apparatus for feeding sheets comprising:

a sheet table for receiving a stack of sheets to be fed, said sheet table having a slanting carrying surface for permitting stacked sheets to slide downward by the force of gravity;

stop means selectively positionable in stop and release positions for retaining and aligning said stacked sheets on said carrying surface when selectively disposed in said stop position and for allowing said stacked and aligned sheets to slide downward along said carrying surface by the force of gravity when selectively disposed in said release position;

first drive means for selectively moving said stop means between said stop position and said release position;

guide means, having a static guide surface against which the sheets strike such that the forward edges of said sheets are aligned thereon, said guide means for guiding forward edges of said sheets as they slide down along said carrying surface in a predetermined direction when said stop means is moved to said release position by said first drive means, said carrying surface and said guide surface forming an obtuse angle;

pick up means, disposed at the leading edge of said guide means in the feeding direction and contacting the forward edge of the uppermost sheet of the sheets aligned on said guide means, for picking up and delivering such uppermost sheets one by one;

second drive means for driving said pick up means; and tapping means, disposed under a central portion of said sheet table, for causing said stop means to tap the sheets on said sheet table after the forward edges of the sheets strike against the guard face to forwardly feed the sheets aligned on the guard surface.

2. An apparatus according to claim 1, wherein said obtuse angle formed between said carrying surface of said sheet table and said guide surface of said guide means ranges from 115° to 150°.

3. An apparatus according to claim 1, wherein said guide means includes a sliding member on said guide surface, having a low coefficient of friction to guide said forward edges of said sheets.

4. An apparatus according to claim 3, wherein said sliding member comprises a plastic film with a smooth surface.

5. An apparatus according to claim 1, wherein said pick up means includes:

an intake roller disposed to touch one side of a sheet guided by said guide means and rotatable in a direction to pick up said guided sheet; and a separating roller touching the other side of said guided sheet and rotatable in either direction to controllably perform pick up of said guided sheet and return of any other sheet.

6. An apparatus according to claim 5, wherein said intake roller and said separating roller are arranged to face each other so that said separating roller contacts a portion of said other side of said guided sheet which corresponds to the contact portion of said one side of said guided sheet touched by said intake roller when said guided sheet is held between said intake roller and said separating roller.

7. An apparatus according to claim 6, wherein said pickup means further includes a torque transmission means for transmitting rotatory force to said separating roller to return a sheet as said intake roller rotates in a direction to pick up said guided sheet.

8. An apparatus according to claim 7, wherein said torque transmission means includes a rotation means for transmitting rotatory force to said separating roller so that said separating roller is rotated at a peripheral speed about three times that of said intake roller.

9. An apparatus according according to claim 8, wherein said intake roller and said separating roller each have frictional members thereon, whereby, when said guided sheet is held between said intake roller and said separating roller, rotatory force is transmitted from the surface of said intake roller to said separating roller to rotate said separating roller in a direction to pickup said guided sheet if the frictional force applied to said frictional member of said separating roller is greater than said rotatory force transmitted by said torque transmission means, and whereby said rotatory force from the torque transmission means is transmitted to said separating roller to rotate said separating roller in a direction to return to said a sheet if the frictional force on said frictional member of said separating roller is smaller than said rotatory force transmitted by said torque transmission means.

10. An apparatus according to claim 9, wherein said frictional member on the surface of said intake roller is formed of natural rubber, and said frictional member on the surface of said separating roller is formed of urethane rubber.

11. An apparatus according to claim 5, wherein said pickup means further includes first sensing means for detecting the existence of an unmanageable number of sheets between said intake roller and said separating roller, and first display means responsive to said first sensing means for indicating the detections thereof.

12. An apparatus according to claim 11, wherein said pickup means further includes a support member rockably supporting said intake roller, and said first sensing means includes a switch member, located close to one end portion of said support member, for being actuated when said one end of said support member is rocked by the existence of said unmanageable number of sheets inserted between said intake roller and said separating roller, to thereby detect sdid existence.

13. An apparatus according to claim 11, wherein said sheet table is provided with second sensing means for detecting the presence of any sheets on said sheet table, and second display means responsive to said second sensing means for indicating the detections thereof.

14. An apparatus according to claim 13, wherein said second sensing means includes a sensor member having one end supported so as to be movable over the sheet table along the sheet stacking direction with the other end thereof rocked as said one end moves, and said second sensing means further includes a second switch member, located close to said other end of the sensor member, for being actuated when said other end of said sensor member is rocked to a fixed position to thereby detect said presence.

15. An apparatus according to claim 1, wherein said sheet table is provided with overset preventing means for preventing more than a predetermining number of sheets from being stacked on said carrying surface.

16. An apparatus according to claim 15, wherein said overset preventing means for an overset preventing member at a fixed position above the sheet table along the sheet stacking direction, so that excess sheets abut against said overset preventing member to be prevented from being fully set on said sheet table when more than the predetermined number of sheets are stacked on said sheet table.

17. An apparatus according to claim 1, wherein said carrying surface of said sheet table has a groove extending at right angles to the sheet downward sliding direction, and one end of said stop means forms a projected member to project above said sheet table through said groove when said stop means is in said stop position and to be located below said sheet table when said stop means is in the release position.

18. An apparatus according to claim 17, wherein said stop means includes a spring disposed at the other end portion of said stop means to urge the same in one direction, and includes cam means, adjoining said other end portion, for pressing said other end portion against the inherent urging force of said spring, whereby the cam presses said other end portion of said stop means against said urging force of said spring so that said one end of said stop means is projected above said sheet table through said groove when said cam means abuts against said other end portion of said stop means.

19. An apparatus for feeding sheets comprising:

a sheet table for receiving a stack of sheets to be fed, said sheet table having a slanting carrying surface for permitting stacked sheets to slide downward by the force of gravity;

stop means for retaining and aligning said stacked sheets on said carrying surface when selectively disposed in a stop position and for allowing said stacked and aligned sheets to slide downward along said carrying surface by the force of gravity when selectively disposed in a release position;

first drive means for selectively moving said stop means between said stop position and said release position;

guide means, having a static guide surface against which the sheets strike such that the forward edges of said sheets are aligned thereon, said guide means for guiding forward edges of said sheets as they slide down along said carrying surface in a predetermined direction when said stop means is moved to said release position by said first drive means, said carrying surface and said guide surface forming an obtuse angle;

pickup means, disposed close to said guide means and contacting the uppermost sheet of the sheets guided by said guide means, for picking up and delivering such uppermost sheets one by one, including:

(a) an intake roller disposed to touch one side of a sheet guided by said guide means and rotatable in a direction to pick up said guided sheet;

(b) a separating roller touching the other side of said guided sheet and rotatable in either direction to controllably perform pick up of said guided sheet and return of any other sheet, wherein said intake roller and said separating roller are arranged to face each other so that said separating roller contacts a portion of said other side of said guided sheet which corresponds to the contact portion of said one side of said guided sheet touched by said intake roller when said guided sheet is held between said intake roller and said separating roller;

(c) torque transmission means for transmitting rotational force to said separating roller to return a sheet as said intake roller rotates in a direction to pick up said guided sheet, said torque transmission means including a rotation means for transmitting rotational force to said separating roller so that said separating roller is rotated at a peripheral speed approximately three times that of said intake roller;

wherein said intake roller and said separating roller each have frictional members disposed thereon, whereby, when said guided sheet is held between said intake roller and said separating roller, rotational force is transmitted from the surface of said intake roller separating roller to rotate said separating roller in a direction to pickup said guided sheet if the frictional force applied to said frictional member of said separating roller is greater than said rotational force transmitted by said torque transmission means, and whereby said rotational force from the torque transmission means is transmitted to said separating roller to rotate said separating roller in a direction to return to said a sheet if the frictional force on said frictional member of said separating roller is smaller than said rotational force transmitted by said torque transmission means;

wherein said torque transmission means includes a first shaft coupled to said separating roller, a second shaft for rotating said separating roller in a direction to return said a sheet, and a coil spring having one end fixed to said first shaft and the other end connected to said second shaft so as to be able to slide thereon under a given frictional force, whereby the rotatory force of said second shaft is transmitted through said coil spring to said first shaft by the given frictional force, and said separating roller is subjected to said rotatory force in said direction to return said a sheet.

20. An apparatus for feeding sheets comprising:

a sheet table for receiving a stack of sheets to be fed, said sheet table having a slanting carrying surface for permitting stacked sheets to slide downward by the force of gravity, said carrying surface of said sheet table having a groove extending at right angles to the sheet downward sliding direction, and one end of said stop means forming a projected member to project above said sheet table through said groove when said stop means is in said stop position and to be be located below said sheet table when said stop means is in the release position;

stop means for retaining and aligning said stacked sheets on said carrying surface when selectively disposed in a stop position and for allowing said stacked and aligned sheets to slide downward along said carrying surface by the force of gravity when selectively disposed in a release position, wherein said stop means includes a spring disposed at the other end portion of said stop means to urge the same in one direction, and includes cam means, adjoining said other end portion, for pressing said other end portion against an inherent urging force of said spring, and for pressing said other end portion of said stop means against said urging force of said spring so that said one end of said stop means is projected above said sheet table through said groove when said cam means abuts against said other end portion of said stop means;

first drive means for selectively moving said stop means between said stop position and said release oosition, including a drive mechanism for rotating said cam means in one direction, so that said cam means periodically presses said stop means against said urging force of said spring, thereby continuously reciprocating said stop means so that said stop means periodically abuts against the underside of a guided sheet to vibrate the same;

guide means, having a static guide surface against which the sheets strike such that the forward edges of said sheets are aligned thereon, said guide means for guiding forward edges of said sheets as they slide down along said carrying surface in a predetermined direction when said stop means is moved to said release position by said first drive means, said carrying surface and said guide surface forming an obtuse angle;

pick up means, disposed close to said guide means and contacting the uppermost sheets guided by said guide means, for picking up and delivering such uppermost sheets one by one; and second drive means for driving said pick up means.

* * * * *